US005963772A

United States Patent [19]

Jost et al.

[11] Patent Number: 5,963,772

[45] Date of Patent: Oct. 5, 1999

[54] ELECTRICALLY CONDUCTIVE MATERIAL AND METHOD OF MAKING

[75] Inventors: Ernest M. Jost, Plainville, Mass.; Kirk McNeilly, Harmony, R.I.

[73] Assignee: Chemet Corporation, Attleboro, Mass.

[21] Appl. No.: 09/204,805

[22] Filed: Dec. 3, 1998

Related U.S. Application Data

[62] Division of application No. 08/753,528, Nov. 26, 1996, Pat. No. 5,846,288

[60] Provisional application No. 60/007,901, Nov. 27, 1995.

[51] Int. Cl.[6] ..... B22F 1/02

[52] U.S. Cl. ..... 419/21; 419/33; 419/34; 419/38

[58] Field of Search ..... 419/21, 33, 34, 419/38

[56] References Cited

U.S. PATENT DOCUMENTS

| | | | |
|---|---|---|---|
| 4,565,590 | 1/1986 | Grosse et al. | 148/431 |
| 4,808,223 | 2/1989 | Ozaki et al. | 75/235 |
| 5,160,366 | 11/1992 | Shibata | 75/232 |
| 5,223,480 | 6/1993 | Agarwala et al. | 505/1 |
| 5,284,527 | 2/1994 | Smeggil et al. | 148/281 |
| 5,822,674 | 10/1998 | Behrens et al. | 419/21 |
| 5,866,493 | 2/1999 | Lee et al. | 501/134 |

*Primary Examiner*—Daniel J. Jenkins
*Attorney, Agent, or Firm*—John A. Haug

[57] ABSTRACT

Electrical contact material made from intimate mixtures of silver powder and a powder of a second phase material is shown in which the powder of the second phase material is milled to produce a selected grain distribution of approximately 90% less than 7–10 microns, approximately 50% between 2 and 5 microns and approximately 10% less than 0.8 to 1.0 microns. The powder of the second phase material is added to a silver salt solution, ammonium hydroxide and hydrazine hydrate to form a precipitate of second phase material particles covered with silver. For applications in which the particles need to be free flowing the particles are compacted together without any binder, broken into chunks and milled to provide granules. In one embodiment homogeneously doped tin oxide particles are disclosed in which tin oxide and the oxide of the dopant are dissolved in nitric acid to produce finely dispersed tin oxide and dopant oxide. The oxides are calcined and ground to the selected grain size distribution.

4 Claims, 1 Drawing Sheet

ELECTRICALLY CONDUCTIVE MATERIAL AND METHOD OF MAKING

RELATED APPLICATIONS

This is a division of Ser. No. 08/753,528, filed Nov. 26, 1996, now U.S. Pat. No. 5,846,288, which claims priority from Provisional Application 60/007,901 filed Nov. 27, 1995.

BACKGROUND OF THE INVENTION

1. Field of the Invention

This invention relates generally to electrically conductive materials and more particularly to such materials containing silver and metal oxides.

2. Description of Related Art

Silver based composites containing an insoluble second phase material in a silver matrix are conventionally used for electrical contacts due to their performance characteristics relating to contact welding and erosion rates. Silver-cadmium oxide, silver-graphite, silver-tungsten, silver-nickel and silver-tin oxide are examples of such materials as well as certain copper based composites such as copper tungsten. With the exception of silver-cadmium oxide and silver-tin oxide which can also be made by a method involving internal oxidation, composite materials are made by powder metallurgical techniques. The electrical performance of such contact materials depends on the quality and chemical composition of the second phase material, its grain size distribution and homogeneity in the silver matrix. These factors also determine the density of the material after the sintering operation. When the material is used with modern high production rate presses the powder must also be free flowing.

Properties of the insoluble second phase material and its interaction with the silver matrix provide a unique electrical contact performance. Every time an electrical contact is engaged with a mating contact to close an electrical circuit or disengaged to open such a circuit an electric arc is ignited. The intensity of the energy of these arcs melt the silver matrix at the arc spots on both respective contacts.

The metal oxides forming the insoluble second phase material interact with these arcs in three major ways. First, the arc thermally decomposes the metal oxides. By way of example, in the case of cadmium oxide and tin oxide they are decomposed according to the following formulas:

$$CdO \longleftrightarrow Cd+O \text{ and}$$

$$SnO_2 \longleftrightarrow SnO+O$$

The energy required for this decomposition is on the order of over a thousand joules per gram of oxide. The withdrawal of this energy cools off or "quenches" the arc. A cooler or quenched arc vaporizes and expels less molten silver and therefore diminishes erosion of the contact material.

Second, the thermal decomposition reaction of the oxides influences the strength of welds that always occur when the contacts close. An electric arc which ignites prior to the closing of contacts forms a molten silver pool. Molten silver, which dissolves approximately one hundred times more oxygen than solid silver, rapidly dissolves the oxygen that the thermal decomposition reaction generates. Following the closure of the contacts the solidifying silver pool expels the excess oxygen. As a result, the weld nugget becomes very porous and mechanically weak and breaks easily when the circuit is switched off and the contacts opened.

The third interaction relates to the effect of the metal oxides on the so-called "spitting" type erosion. The molten silver pool at the arc spots swirl rapidly under the forces of alternating magnetic fields. The magnetic force agitates the surface and forms rapidly moving standing waves and expels molten silver droplets from the molten surface. Loss of this silver is a major factor in contact erosion.

Metal oxide particles increase the viscosity of the melt and reduce the swirling and wave motions. As a consequence the molten pool loses fewer silver droplets and the spitting erosion is reduced.

However, molten silver must wet the metal oxide for all three mechanisms to be operative. Without wetting the metal oxide particles are ejected from the silver pool and deposited on the silver surface. Under such a condition arc quenching may still be operative, at least initially, however, the other two mechanisms, namely oxygen absorption by the melt and the melt viscosity are adversely effected. Decomposition of the oxide now occurs on the surface and the molten silver pool cannot readily absorb the evolving oxygen. Weld forces increase and the likelihood of failure due to strong welds increases. The melt contains fewer metal oxide particles and therefore the viscosity decreases and spitting type erosion increases. In addition to the above, the oxide layers that accumulate on the surface increase the contact resistance and lead to over-heating of the switching device.

Although molten silver readily wets some oxides it does not wet certain other oxides such as pure tin oxide. It is known to coat tin oxide powder, as shown in FIG. 1, with a dopant such as copper oxide, bismuth oxide, tellurium oxide, tungsten oxide, and molybdenum oxide to lower the surface tension and promote wetting by molten silver. Silver powder is added to the oxide powder and mixed in a suitable mixing machine. It is conventional to make strip or wire shapes by extruding and rolling billets made with these mixtures. Such processing, however, tends to break the tin oxide particles and in so doing exposes undoped tin oxide surfaces as noted in FIGS. 2*a*, 2*b* and 2*c*. The dopant coating is also striped off particles by the electric arc generated during contact closing and opening to further expose pure tin oxide surfaces. Molten silver wets such particles poorly and tends to expel them from the molten pool as previously described. Materials produced with such doping methods end up increasing welding and erosion tendencies.

SUMMARY OF THE INVENTION

It is an object of the present invention to overcome the prior art limitations noted above. Another object of the invention is the provision of improved intimate mixtures of silver particles and metal oxide powders and a method for producing such mixtures. Yet another object is the provision of mixtures of silver powder and metal oxides suitable for use in strip or billet compacting of such powders having improved flow characteristics for use with high speed pill pressing applications. Still another object is the provision of improved doped metal oxides for promoting wetting by molten silver and methods for producing such doped metal oxides.

Briefly, in accordance with one embodiment of the invention, second phase materials, such as tin oxide, are milled to produce a suitable grain size distribution. Preferably the grain size distribution has no particles larger than 100 microns, approximately 90% less than 7–10 microns, approximately 50% between 2 and 5 microns and approximately 10% less than 0.8 to 1.0 microns. According to the invention the oxide powder is added to and suspended with vigorous agitation in a concentrated 0.1–7.5 molar solution of a silver salt such as silver nitrate and then sprayed into a vessel containing a stoichiometric amount of a suitable reducing agent, such as hydrazine, and ammonia with the silver precipitating as a powder around tin oxide powder. The powder mixture is washed, dried and sieved and is then ready for use in various applications such as strip or billet compacting. According to a modified embodiment of the invention the oxide powder, silver nitrate and ammonia are mixed together in a vessel and sprayed into hydrazine or alternatively, hydrazine is sprayed into the noted contents of the vessel.

According to another feature of the invention, when the powder mixture is to be used in applications requiring free flowing characteristics such as in a high speed pill pressing applications, the powders, without the use of binders, are continuosly compacted and then broken up into approximately one inch square pieces and then ground using a suitable mill. The resulting agglomerated powder is sieved and ready for use.

According to another embodiment of the invention doped tin oxide is prepared by reacting the dopant and tin oxide prior to mixing with silver powder to provide a homogeneous mixture as shown in FIGS. 3*a* and 3*b*. Homogeneously doped tin oxide particles expose the same surface composition after breaking or rupturing during metallurgical processing operations. Tin and the dopant material such as copper, bismuth or tellurium are dissolved in nitric acid to produce a finely dispersed tin oxide and an oxide of the dopant. The NOX gases are recombined with oxygen and water, the pH is adjusted to 7 with ammonium hydroxide, decanted and the mixture dried. The mixture is then sieved and calcined until the surface area reduces to a selected degree. The calcined oxides are broken up and ground to a powder by milling in a suitable mill such as an attrition mill or jet mill. The contents are then washed and dried. Silver powder is then mixed into the milled oxides and pressed to achieve a green density of 50–60% of theoretical value. Sintering of the compact for approximately one hour at 900 degrees C. results in a winter density of 90–95%.

BRIEF DESCRIPTION OF THE DRAWINGS

Other objects, advantages and details of the invention appear in the following detailed description of preferred embodiments of the invention, the detailed description referring to the drawings in which.

DESCRIPTION OF PREFERRED EMBODIMENTS

Figure 1:
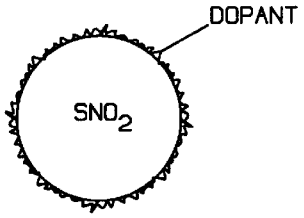
FIG. 1 shows a tin oxide particle having a deposit of dopant on the surface thereof in accordance with prior art techniques.
Figure 2A:
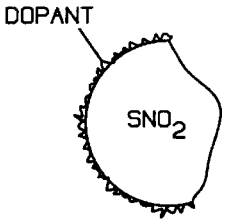
FIGS. 2*a,* 2*b,* 2*c* show fragments of the FIG. 2 particle.
Figure 2B:
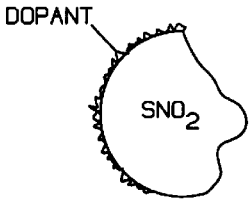
Figure 2C:
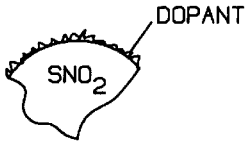

In accordance with one embodiment of the invention a method is provided for making homogeneous mixtures of silver powder and various materials for use in so-called composite electrical contact materials. The method not only provides a homogeneous distribution of the components but also ensures that electrical contacts made with these powder mixtures will densify to very high densities during the sintering operation.

In making discrete electrical contacts by powder metallurgical techniques the steps of pressing, sintering and coining are of particular importance. The electrical performance of the contacts depends on the quality and chemical composition of the second phase material, its grain size distribution and homogeneity in the silver matrix. These factors also determine the density after the sintering operation. The powder must be free flowing to satisfy the requirements of a modern high speed production rate pill press.

In accordance with the invention, the second phase material, for example, doped tin oxide, is milled in a conventional jet mill or attrition mill and sieved to produce a grain size distribution in which no particles are larger than approximately 100 microns, 90% are less than approximately 7–10 microns, 50% are between approximately 2 and 5 microns and 10% are less than approximately 0.8 and 1.0 microns. The grain size distribution for a doped tin oxide milled in accordance with the invention as discussed herein, was measured with a Leads and Northrup Microtrak analyzer.

The second phase material is added and suspended with vigorous agitation in a concentrated solution from 0.1 to 7.5 molar solution, and preferably from 4 to 6 molar solution of silver nitrate. The solution is then sprayed into a vessel of hydrazine and ammonia to complete the following reaction:

$$Ag\ NO_3+\tfrac{1}{4}N_2H_4+(NH)_4\ OH \longleftrightarrow Ag+\tfrac{1}{4}N_2+H_2O+(NH)_4\ NO_3$$

The silver precipitates as a powder around the second phase powder. The chemical powder mixture is then sieved and ready for use in various applications, for example for strip or billet compacting.

EXAMPLE 1

In order to produce a 1000 Toz (31.000 grams) batch of silver 87%, tin oxide 11%, bismuth oxide 2%, 130 Toz (4.043 grams) of a calcined or heat treated tin oxide (84.62%) and bismuth oxide (15.38%) mixtures were weighed. The surface area as measured with a BET apparatus was 0.6 meter squared per gram. The particle size distribution as measured with a Leads and Northrup Microtrak analyzer contained no particles larger than 8 microns, 50% were less than 4 microns and 10% were less than 0.8 microns. This powder was added to 50 liters of a 5 molar aqueous silver nitrate solution and mixed vigorously. Two hundred liters of a solution of 1.5 moles/liter solution of ammonium hydroxide and 0.375 moles/liter of hydrazine hydrate were placed in a large reaction vessel and stirred vigorously. The tin and bismuth oxide and silver nitrate solution was then injected into the reaction vessel through a nozzle. The reaction was completed in approximately 30 to 45 minutes. The reaction liquid and suspended silver and oxide solids were emptied into a filter crock and washed with deionized water until all ammonium nitrate was removed. The powder was placed in stainless steel trays and dried in a vacuum at 100 degrees C. and then sieved through a 50 mesh screen. The resulting silver-tin-bismuth oxide powder is suitable in this form for the purpose of strip and billet compacting.

EXAMPLE 2

The above example was repeated except that the washed silver-tin-bismuth oxide powder was dried in air at 250 degrees C.

The process employed in the above examples can be modified by placing the oxides, silver nitrate and ammonia in a reaction vessel and spraying that into hydrazine or alternatively spraying the hydrazine into the contents of the reaction vessel. While this modification is not appropriate when copper is used as the dopant due to its solubility in ammonia, it is effective with dopants such as bismuth.

EXAMPLE 3

In order to increase free flowing characteristics to the powder to make it suitable for use in high speed pill presses the powder of examples 1 and 2, without any binders which could interfere with the sintering process to be performed later, were compacted into a continuous strip 0.2 to 0.5 inches in thickness in a continuous compacting tray at a pressure of approximately 1500 psi. Any suitable pressure between approximately 1,500 and 10,000 psi can be used. The resulting compact had an apparent density of approximately 42% and, depending on the pressure employed, could be up to approximately 43%. The compact was easily broken into pieces approximately 0.5 to 1.0 square inches in area and then granulated by being passed through a slowly rotating Buhrstone mill. The resulting powder was sieved through a 30 mesh screen to remove large particles and fines were removed by using a 325 mesh screen. The sieved powder was characterized by being free flowing. Discrete contacts made with this procedure were sintered for one hour at 900 degrees C. and achieved a density of 95 to 97% of theoretical density. The resulting yield was 98%.

Although a Buhrstone mill was employed in the above example it will be understood that other suitable mills can be used, such as hammer mills, pin mills, jet mill and the like.

EXAMPLE 4

In order to produce 1000 Toz (31.100 grams) batch of 90% silver, 10% copper doped tin oxide, 3,100 grams of copper doped, calcined tin oxide containing 4% copper were weighed. The surface area of the doped tin oxide was approximately 0.7 meters squared per gram and had a distribution of particles in which there were no particles over 8 microns, 50% of the particles were less than 3.5 microns and 10% of the particles were less than 0.6 microns. This powder was put into a 43.1 liter solution of a 6 moles/liter silver nitrate and stirred vigorously. The solution was then injected through a nozzle into a vigorously stirred 250 liter solution of 1.25 moles/liter ammonium hydroxide and 0.31 moles/liter hydrazine. The reaction was completed in approximately 30 minutes. The suspended particles were separated from the solution in a filter crock, washed and dried in the same manner as described in Example 1. The powder was ready for use for strip or billet compacting.

EXAMPLE 5

The powder of Example 4 was compacted and granulated in the same manner as described in Example 3 to provide free flowing characteristics.

Figure 3A:
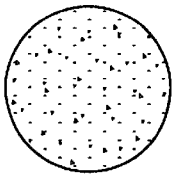
FIGS. 3*a*, 3*b* show a whole tin oxide particle doped in accordance with the invention and a fragment of such particle respectively.
Figure 3B:
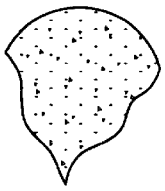

According to another embodiment of the invention, homogeneously doped particles are produced by reacting the dopant and oxide of the secondary material prior to mixing with silver powder to provide a homogeneous mixture as shown in FIGS. 3*a* and 3*b*. Homogeneously doped oxide particles expose the same surface composition after breaking or rupturing during metallurgical processing operations. For example, tin and the dopant material such as copper, bismuth or tellurium are dissolved in nitric acid to produce a finely dispersed tin oxide and an oxide of the dopant. The NOX gases are recombined with oxygen and water, the pH is adjusted to 7 with ammonium hydroxide, decanted and the mixture dried. The mixture is then sieved and calcined until the surface area reduces to a selected degree. The calcined oxides are broken up and ground to a powder by milling in a suitable mill such as an attrition mill or jet mill. The contents are then washed and dried. Silver powder is then mixed into the milled oxides and pressed to achieve a green density of 50–60% of theoretical value. Sintering of the compact for approximately one hour at 900 degrees C. results in a sinter density of 90–95%. Examples of this embodiment are given below.

EXAMPLE 6

Two hundred ninety five (295) grams of tin metal and ten (10) grams of copper were dissolved in nitric acid producing a finely dispersed tin oxide and copper oxide mixture:

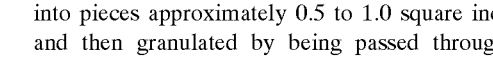

$$Sn+2HNO_3 \longleftrightarrow SnO_2+N_2O_3+H_2O \text{ and}$$

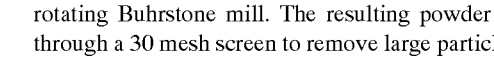

$$Cu+3HNO_3 \longleftrightarrow Cu(NO_3)_2+1\tfrac{1}{2}H_2O+\tfrac{1}{2}H_2O_3$$

The NOX gases were recombined with oxygen and water to recover the excess nitric acid according to the following chemical reaction formula:

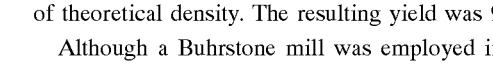

$$N_2O_3+H_2O+O_2 \longleftrightarrow 2HNO_3$$

The pH was adjusted to 7 with ammonium hydroxide and the suspension of oxides allowed to settle. The excess liquid was then decanted and the resulting slurry was placed in stainless steel trays and dried at 250 degrees C. (250–300 degrees C. being suitable) for several hours to dry the oxides and eliminate all ammonium nitrate. The dried oxide mixture had a surface area of 10–60 meters squared per gram. The mixture was sieved through a 150 mesh screen and heated at 1100 degrees C. for 40 hours (40–80 hours is typical for the time required) for the surface area to reduce to approximately 0.2 to 0.8 meters squared per gram. The mixture was then broken up and ground to a powder that passed through a 150 mesh sieve.

The mixed oxides were then placed in an attrition mill in an aqueous medium and milled until the particle size, measured by a Leads and Northrup particle size analyzer, is less than 8 microns and the average particle size measured approximately 4 microns. The milling time took approximately 5 hours. Approximately one half liter of water per kilogram of the oxides was used, however, the proportion is not critical. The desired particle size distribution of the oxides can be achieved with different water to powder ratios and appropriate milling times. After the milling operation the mill was then emptied and the contents washed by adding additional water. Silver powder was then added along with Wicolate SE5, a suitable wetting agent, in a Hobart type mixer and mixed for approximately one hour. Other surfactants of similar chemical composition can also be used. The wet mix was then dried in hot air at 200 degrees C. (200–300 degrees C. is suitable—the mix can also be dried in vacuum at approximately 100 degrees C.) until fully dry.

The dry powder mix was then pressed at approximately 4000 psi (4000–8000 psi being suitable) to achieve a green density of 50–60% of theoretical value and this was then sintered for approximately one hour at 900 degrees C. and obtained a sinter density of 93 to 95%.

EXAMPLE 7

Two hundred ninety five (295) grams of tin metal and ninety four (94) grams of bismuth trioxide were dissolved in the appropriate amount of nitric acid and the resulting oxide precipitation was treated as described in Example 6. The mixed powders were dried, sieved and calcined in the same manner as described in that example. The tin oxide and bismuth oxide reacted during this preparation to form the ceramic compound $Bi_2Sn_2O_7$. The oxides were milled in an aqueous slurry to achieve the same particles size distribution as that described in Example 1. Silver powder and a surfactant were added and mixed as in Example 6 producing a silver-tin oxide-bismuth oxide mixture. The dry mixture was pressed to 50–60% green density and sintered as in Example 6 for one hour at 900 degrees C. resulting in a density of 94–98% of theoretical density.

EXAMPLE 8

In this example bismuth was substituted-by tellurium and treated in the same manner as described in Example 7. The density of the compact prepared in this way reached 94–96% of theoretical density.

It will be understood that the particular parameters used for sintering including the time, temperature and atmosphere can be varied in a known manner as desired.

The following table lists some of the electrical tests performed with silver-doped tin oxide contacts with the method of dopant addition being noted as (O) for coated particles and (N) or homogeneous particles. In all cases the erosion, which is the most important characteristic for an electrical contact material is lower than it is for contact material produced in a conventional manner. Although the weld forces and electrical resistance of the contacts are not always lower than those of conventionally formed materials they are within an acceptable range.

TABLE 1

| Composition of material $Ag/SnO_2$ | Dopant in % of total weight | Method of Dopant addition Coat (O) Homo (N) | Electric Test Type AC | Electric Load Amperes | Erosion Loss per cycles in $\mu g$ | Weld Force in Newtons (N)'s | Resistance of Contacts in uΩ |
|---|---|---|---|---|---|---|---|
| 90/10 | Cu 0.4 | N | AC3 | 25 | 2.1 | 4.4 | 41 |
| 90/10 | Cu 0.4 | O | AC3 | 25 | 4.1 | 7.6 | 85 |
| 90/10 | Cu 0.4 | N | AC4 | 25 | 2.1 | 9.4 | 42 |
| 90/10 | Cu 0.4 | O | AC4 | 25 | 5.9 | 11 | 41 |
| 90/10 | Bi 1.0 | N | AC3 | 25 | | | |
| 90/10 | Bi 1.0 | O | AC3 | 25 | | | |
| 90/10 | Bi 1.0 | N | AC4 | 25 | | | |
| 90/10 | Bi 1.0 | O | AC4 | 25 | | | |
| 90/10 | Cu 0.4 | N | AC3 | 50 | 11.4 | 4 | 30 |
| 90/10 | Cu 0.4 | O | AC4 | 50 | 17.3 | 3.8 | 56 |
| 90/10 | Cu 0.4 | N | AC3 | 100 | 22.6 | 9.1 | 48 |
| 88/12 | Cu 0.4 | N | AC3 | 50 | 6.2 | 4.6 | 64 |
| 88/12 | Cu 0.4 | O | AC3 | 50 | 11.8 | 7.7 | 30 |
| 88/12 | Cu 0.4 | N | AC4 | 50 | 10 | 12.6 | 67 |
| 88/12 | Cu 0.4 | O | AC4 | 50 | 20 | 17 | 27 |
| 88/12 | Bi 1.0 | N | AC3 | 50 | | | |
| 88/12 | Bi 1.0 | O | AC3 | 50 | | | |
| 88/12 | Bi 1.0 | N | AC4 | 50 | | | |
| 88/12 | Bi 1.0 | O | AC4 | 50 | 13 | 16 | 50 |
| 88/12 | Cu 0.4 | N | AC3 | 100 | | | |
| 88/12 | Cu 0.4 | O | AC3 | 100 | | | |
| 88/12 | Cu 0.4 | N | AC4 | 100 | | | |
| 88/12 | Cu 0.4 | O | AC4 | 100 | | | |
| 88/12 | Bi 1.0 | N | AC3 | 100 | 42 | 11.5 | 25 |
| 88/12 | Bi 1.0 | O | AC3 | 100 | 93 | 8 | 18 |
| 88/12 | Bi 1.0 | N | AC4 | 100 | 41 | 7.7 | 50 |
| 88/12 | Bi 0.1 | O | AC4 | 100 | 250 | 7 | 22 |

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed:

1. A method for making doped tin oxide powder having improved molten silver wetting characteristics comprising the steps of dissolving tin powder and dopant powder to form oxides of tin and the dopant material, recovering excess nitric acid, adjusting the pH to approximately 7 with ammonium hydroxide and allowing the suspension of oxides to settle, decanting the excess liquid, drying the oxides, sieving the oxides, calcining the oxides at approximately 1100 degrees centigrade until the surface area reduces to approximately 0.2 to 0.8 meters square per gram, breaking the calcined oxides into small pieces and grinding the pieces of calcined oxides into a powder having homogeneously doped tin oxide particles.

2. A method according to claim 1 in which the dopant material is selected from the group consisting of bismuth, copper and tellurium.

3. A method according to claim 1 including th steps of milling the homogeneously doped tin oxide particles in a liquid medium until the maximum particle size is less than 8 microns, adding silver powder and pressing the powder mix to acieve a green density of 50–60% of the theoretical value, and sintering the pressed powder mix.

4. A product made according to the method of claim 2.

* * * * *